US006765503B1

(12) United States Patent
Chan et al.

(10) Patent No.: US 6,765,503 B1
(45) Date of Patent: Jul. 20, 2004

(54) BACKLIGHTING FOR COMPUTER KEYBOARD

(75) Inventors: Sam E. J. Chan, Kowloon (HK); King Sum Chu, Kowloon (HK); W. Edward Church, Tampa, FL (US); Randall Krafft, Tampa, FL (US)

(73) Assignee: Lightpath Technologies, Inc., Tampa, FL (US)

( * ) Notice: Subject to any disclaimer, the term of this patent is extended or adjusted under 35 U.S.C. 154(b) by 0 days.

(21) Appl. No.: 09/831,777

(22) PCT Filed: Nov. 12, 1999

(86) PCT No.: PCT/US99/27065

§ 371 (c)(1),
(2), (4) Date: Aug. 14, 2001

(87) PCT Pub. No.: WO00/30257

PCT Pub. Date: May 25, 2000

Related U.S. Application Data

(60) Provisional application No. 60/108,310, filed on Nov. 13, 1998.

(51) Int. Cl.[7] ..... F21V 33/00

(52) U.S. Cl. ..... 341/22; 362/30; 362/84; 362/85; 200/310; 200/317; 200/313

(58) Field of Search ..... 341/20, 22; 200/5 A, 200/310, 313, 314, 317; 362/85, 84, 30

(56) References Cited

U.S. PATENT DOCUMENTS

| | | | | |
|---|---|---|---|---|
| 3,856,127 | A | 12/1974 | Halfon et al. | 197/98 |
| 4,060,703 | A | 11/1977 | Everett, Jr. | 200/5 A |
| 4,320,268 | A | 3/1982 | Brown | 200/5 A |
| 4,379,968 | A | 4/1983 | Ely et al. | 250/229 |
| 4,551,717 | A | 11/1985 | Dreher | 340/712 |
| 4,617,461 | A | 10/1986 | Subbarao et al. | 250/229 |
| 4,667,273 | A | 5/1987 | Queudray | 362/34 |
| 4,772,769 | A | 9/1988 | Shumate | |
| 4,806,908 | A | 2/1989 | Krupnik | 341/22 |
| 4,811,175 | A | 3/1989 | DeSmet | 362/95 |
| 4,812,831 | A | 3/1989 | Laier | 340/711 |

(List continued on next page.)

FOREIGN PATENT DOCUMENTS

| | | |
|---|---|---|
| DE | 3535217 | 4/1986 |
| EP | 1 108 183 | 7/1999 |
| JP | 09038654 | 2/1997 |

OTHER PUBLICATIONS

Translation of DE 3535217, Apr. 17, 1986, Germany.

*Primary Examiner*—Albert K. Wong
(74) *Attorney, Agent, or Firm*—Pedersen & Co., PLLC; Ken J. Pedersen; Barbara S. Pedersen

(57) ABSTRACT

Embodiments of a peripheral backlighting system for keyboards are shown and described, which include one or more light-emitting panels exterior to the keyswitches of the keyboard. The panels are preferably electroluminescent material and surround at least two sides, and preferably all sides, of the stem of a keyswitch or the space in which the stem slides up and down during use. Alternatively, the electroluminescent panel(s) may extend substantially continuously between and underneath a plurality of keyswitches. The panels extend closely adjacent to the stem or stem path, or under the keyswitch, to be as far under the key cap as possible without extending into the stem or cap of the keyswitch. The EL panels are preferably powered by the computer keyboard port, via voltage inverters. Preferably, the keyswitch is translucent or partially translucent, and the base plate over the EL panels, if any, is at least partially translucent or transparent. This way, the light from the light-emitting panels radiates upward through, and preferably around the outer surface of, the translucent keycaps, rather than up through an aperture or lightpipe in the center of the keycaps.

37 Claims, 8 Drawing Sheets

U.S. PATENT DOCUMENTS

| | | | | |
|---|---|---|---|---|
| 4,814,566 | A | 3/1989 | Sigl | 200/305 |
| 4,882,581 | A | 11/1989 | Inobe et al. | 341/22 |
| 4,931,794 | A | 6/1990 | Haag et al. | 341/31 |
| 5,034,602 | A | 7/1991 | Garcia, Jr. et al. | 250/227.22 |
| 5,073,843 | A | 12/1991 | Magee | 362/84 |
| 5,083,240 | A | 1/1992 | Pasco | 362/26 |
| 5,138,119 | A | 8/1992 | Demeo | 200/5 |
| 5,149,923 | A | 9/1992 | Demeo | 200/5 |
| 5,266,949 | A | 11/1993 | Rossi | 341/22 |
| 5,397,867 | A | 3/1995 | Demeo | 200/5 |
| 5,430,267 | A | 7/1995 | Ozeki et al. | 200/302.2 |
| 5,510,782 | A | 4/1996 | Norris et al. | 341/22 |
| 5,565,733 | A | 10/1996 | Krafcik et al. | 313/510 |
| 5,581,251 | A | 12/1996 | McRight et al. | 341/22 |
| 5,612,692 | A | 3/1997 | Dugas et al. | 341/22 |
| 5,664,860 | A | 9/1997 | Berardi | 362/23 |
| 5,708,428 | A | 1/1998 | Phillips | 341/22 |
| 5,736,233 | A | 4/1998 | Fye | 428/804 |
| 5,747,756 | A | 5/1998 | Boedecker | 200/5 A |
| 5,797,482 | A | 8/1998 | LaPointe et al. | 200/314 |
| 5,801,345 | A | 9/1998 | Mikula-Curtis et al. | 200/5 A |
| 5,811,930 | A | 9/1998 | Krafcik et al. | 313/510 |
| 5,821,482 | A | 10/1998 | Ootani et al. | 200/5 A |
| 5,899,553 | A | 5/1999 | Howell | 362/84 |
| 5,938,772 | A | 8/1999 | Welch | 713/320 |
| 5,971,557 | A | 10/1999 | Kubes et al. | 362/24 |
| 6,006,118 | A | 12/1999 | Stephenson | 455/575 |
| 6,179,432 | B1 | 1/2001 | Zhang et al. | 362/84 |
| 6,199,996 | B1 | 3/2001 | Katrinecz, Jr. et al. | 362/85 |
| 6,467,924 | B2 * | 10/2002 | Shipman | 362/31 |

* cited by examiner

BACKLIGHTING FOR COMPUTER KEYBOARD

DESCRIPTION

This national application filed under 35 U.S.C. 371 claims priority of PCT/US99/27065, filed on Nov. 12, 1999, and U.S. Provisional patent application Ser. No. 60/108,310, filed Nov. 13, 1998.

BACKGROUND OF THE INVENTION

1. Field of the Invention

This invention pertains, in general, to lighting devices for keyswitch assemblies and keyboards, such as computer desktop, laptop, and notebook keyboards or "Internet-TV" keyboards. More specifically, the invention relates to backlighting for keyboards that originates from below the keys within the keyboard.

2. Related Art

For a long time, keyswitch assembly operators have desired lighted keyboards and keypads. For example, when an operator is working a computer keyboard and simultaneously viewing a computer monitor, low ambient light conditions may be preferred, in order to maximize contrast on the monitor screen. Also, for example, a portable computer operator may by necessity be in a low light environment, as when flying in an airplane or riding in a train at night.

In any event, there have been many attempts in the prior art to provide lighted keyboards and keypads. Still, many of these attempts have not been successful because they result in keyswitch assemblies that are not sufficiently lighted, or lighted in a glaring or distracting manner, or that are inconvenient, or expensive. Prior attempts at lighted keyboards have produced fragile systems that consume more power and produce more heat than is desirable.

Examples of lighted keyswitch assemblies are found in the patent literature. U.S. Pat. No. 5,801,345 (Mikula-Curtis et al., 1998) discloses LED's attached to the bottom of the printed circuit board (PCB) which emit light that travels up through holes in the PCB and into light pipes, each of which is received in a key cap to channel the light up through the interior of the key cap. Also, the Mikula-Curtis et al. system includes a backlighting system with an LED centered under a light dam and an indicia panel, that emits light up through the center of the area enclosed by the light dam to back-light the indicia panel.

U.S. Pat. No. 5,612,692 (Dugas et al., 1997) discloses a sealed, LED-lighted keyboard, in which the LEDs are disposed on the printed circuit board. The LEDs and circuit board are covered by a spacer board with openings for allowing electrical contact with the top surface of the circuit board and for allowing LED light to reach the upper layers of the system. These "upper layers" include a translucent sealing sheet membrane with domes, and keys above the domes. Thus, in Dugas, the keys are pushed down to force the domes down so that a conductive under-surface of the key may contact the circuit board. The LED light must travel up through the spacer board holes, through the center of each dome, up through the center of each key, and out the translucent number, letter, or other indicia on the top center of the key cap.

U.S. Pat. No. 5,034,602 (Garcia, et al., 1991) discloses a backlighting system in which a light emitter, such as an alpha/numeric LED or LCD, is disposed beneath the center of the key cap or adjacent to a beam splitter that redirects the light up through the central axis of the key cap.

U.S. Pat. No. 4,806,908 (Krupnik, 1989) discloses a system using electroluminescent (EL) strips that extend through registering openings that extend transversely through the stems of the key switches in the keyboard. The EL strips extend from key stem to key stem underneath an opaque, stationary retaining panel being between the keys, so that only the key cap is lit only by light that is emitted from the area of the EL strips inside the key stems (the "internal portion") and that travels up to the cap of the key. This light from the internal portion of the EL strip travels up through the center of the clear, transparent, or translucent body of the key stem and then to openings or translucent areas in the center of the otherwise opaque key cap. Because the EL strips run underneath the opaque retaining panel and through openings in the stems of a plurality of keys, the EL strips are also adapted to prevent withdrawal of the keys from the retaining panel.

Summarily, therefore, conventional backlighting techniques feature means for channeling/directing light directly up through the center of the key cap or of the area directly under the indicia panel to be lit. This approach purposely controls the light to travel along a specific central axis and then to radiate from the keyboard in a limited area of a single key cap or of a single indicia panel. This approach purposely controls and limits the light path, to prevent light from traveling from keyswitch to keyswitch or from shining from the inside of the keyswitch to the outside of the keyswitch.

What is still needed is a durable, economical and effective backlighting system for a desktop, laptop, notebook, or "Internet-TV" keyboard. What is needed is such a system that supplies appropriate levels of light in the appropriate areas of the keyboard for enhanced viewing in low/no light environments.

SUMMARY OF THE INVENTION

The present invention comprises lighting a keyboard for use in low or no ambient light environments, by peripherally lighting the keyswitch assemblies on a keyboard or keypad, such as a desktop, laptop, notebook, or Internet-TV keyboard. By "peripherally lighted," it is meant that the keyswitch assemblies are lit externally, from outside rather than from inside, preferably from positions substantially circumscribing the sides and/or extending across the bottom of the keyswitch assemblies. Light emanates from all or portions of a panel that extends between and/or underneath a plurality of keyswitches of a keyboard. The panel may be a sheet or strip that extends between keyswitches and preferably reaches underneath the keycaps, by extending near to the stem or stem path of a keyswitch, and/or by extending underneath the keyswitches. Preferably, light emanates up from the radiant panel through the spaces between the keyswitches, and into and through the keyswitches, to give the selected portions of the keyboard an overall "glowing" appearance, rather than giving the keyboard the appearance of having "spots" of light or lighted letters and numerals. This lighting aids key identification and overall visibility in many low/no light environments, and makes laptop lighting possible while traveling because of low power consumption.

Preferably, the radiant panel is electroluminescent (EL) material positioned above the contact membrane or printed circuit board and generally below the keyswitch caps. In embodiments in which the EL material comprises strips or a sheet with perforations, the strip edges or perforation edges are disposed on at least two sides of, and preferably entirely or substantially around, the key stem or the space through which the stem travels during depression of the key ("stem path"). In embodiments in which the EL material comprises a continuous sheet of material, the sheet extends generally horizontally underneath a plurality of keyswitches between the contact membrane and the lower-most extremity of the keyswitch. When a key is depressed, the continuous sheet is impacted by the contact member of the keyswitch, and transfers force to the contact membrane to execute the "switch." Thus, at a minimum, the EL material preferably extends underneath the peripheral edges of the key cap, or at a maximum, the EL material extends all the way under the key, either scenario allowing a significant amount of light to pass into and up through the keyswitches, and preferably also between the spaces between the keyswitches. The panel and EL material preferably do not extend into the interior of the key cap or key stem, and do not interfere with operation or removal of the key.

In this and the following Description and Claims, the terms "keyswitch assembly" or "keyswitch" or "key" refer to the device conventionally provided in keyboards that is depressed to make contact with and affect (close) its particular switch on the circuit board or membrane (PCB or contact membrane). A keyswitch is typically made of what is called herein a "cap" for finger contact and a "key stem" or "stem" which is the generally vertical structure protruding from the cap toward the circuit board or membrane and which contacts the board or membrane when the key is depressed. Thus, "key stem" herein refers to the downwardly-protruding post attached to the cap, plus inserts, sleeves, domes, and biasing members that extend around or are otherwise connected to the post. The cap and stem of a keyswitch may be separate components, or may be a single component plus a biasing member, for example. In the Description and Claims, the term "substantially continuous panel" means that a panel extends without significant apertures or interruptions except for apertures that are used to receive a portion of the keyswitch such as the stem or to reach near to the stem but leave a space for the stem path, that is, for the stem to move in and out of the aperture. The term "continuous panel" means that the panel extends without significant apertures or interruptions, for example, panels that have no apertures for receiving the keyswitch stems. The inventors envision that a single continuous panel would be beneficial in a laptop computer keyboard that would have no keyswitch stem apertures but would have a hole through the membrane for receiving a "mouse ball" mechanism, for example. The term "extending between" means that a panel extends from keyswitch to keyswitch on any number of planes that are near the keyswitches and generally parallel to the plane of the keyswitches, and is not intended to limit the panel location to one particular plane passing through the midpoint of the keyswitches.

One or more panels comprising EL material may be laid down between keyswitches and around the stems or stem paths or underneath the keyswitches, in one or more areas of the keyboard. The panels may be of various regular or irregular shapes to backlight particular areas of the keyboard, and the panels may radiate light over all or substantially all of their top surfaces, or may have areas masked or deactivated from radiating light so that not all of the panel radiates light. Panels are herein described in two general categories, sheets and strips, wherein a sheet typically extends between more than two rows of keys and/or more than two columns of keys, and a strip typically extends between only two rows of keys or between only two columns of keys. Several different panels may be provided, for easier design and installation, or for being separately-powered for independent on/off or dimming control. Also, EL panels may be used that provide different colors of backlighting, for differentiating different areas of the key board. Also, not all areas of the keyboard need to be lit.

Preferably, the keycaps used with the present invention are molded using translucent plastic and have opaque markings or portions on their tops, and the key stems and other parts of the keyswitches are either translucent, transparent, or reflective, so that the keyswitch as a whole tends to transfer or reflect light. Also, the EL material may be positioned directly underneath a translucent or transparent base plate that is the uppermost portion of the housing of the keyboard. Alternatively, the EL material may be positioned above a base plate, or installed without a base plate. This way, because the EL material preferably extends across substantially the entire distance between keys, and optionally across the entire distance outside and beneath the keys, the EL light travels upward through and around the translucent keycaps and up through the base plate, thereby backlighting selected portions or substantially the entire top of the keyboard, to "fill" the keyboard surface with light. Thus, the invented system does not feature only the interior lighting, that is, the limited, controlled "light pipe" or axially-channeled light approach discussed in the Related Art section. Instead, the invented system produces a subtle, overall lighted effect that yet is not overwhelming or distracting. Having light "glow" from between the keycaps as well as from the keycaps is surprisingly effective, and produces a "plane of light" effect, giving the user enough subtle light to see and use the keyboard without having "spots" of light or indicia only lit up on top of the key caps.

The radiant EL panels are preferably powered by the computer keyboard port, via voltage inverters which are commercially available for such use. Preferably, one or more dimming, on/off, and auto-off control systems are included in the invented system. These controls may be used to adjust the intensity of the backlighting in some or all portions of the backlit keyboard. Also, these controls may be used to automatically shut off lighting during extended non-use, for battery conservation, and restart it when one or more keystrokes are made. In addition, the preferred controls may be used to independently dim or turn off the lighting of all or selected portions, for example, to produce increased differentiation between the lit portions and the dimmed or non-lit portions.

The invented backlighting system allows easier key identification for fewer input errors, for example, for late night use without disrupting sleeping family members and use on airplanes. The invented system allows a user to accurately and comfortably use the keyboard after purposely darkening a room to reduce glare and shadows. The overall-lighted keyboard may reduce eye fatigue that otherwise may occur when constantly moving the eyes from a lighted monitor to an un-lit keyboard. The intensity adjustment option gives users the ability to adjust the keyboard lighting for their own personal comfort and room conditions.

Another objective of the invented system is to provide a durable lighting system that results in a durable and low-maintenance keyboard. The invented system may use conventional, solid keyswitches without hollow centers, and does not require hollow key stems or special modifications to keyswitches, except for the preferred change to translucent materials. The invented system does not significantly increase the temperature of the keyswitches. The invented system does not require electronic or other complex connections of lighting members to the keyswitches. The preferred system therefore provides an economical lighting mechanism that does not reduce the reliability and life of the keyboard.

The invented backlighting system utilizes commercially-available lighting members, in such a way as to provide a system of efficient, glare-free and low-cost keyboard illumination. The invented system of lighting can be made into any shape of size, for design into new keyboard assemblies, or retrofitting onto existing keyboards, as will be more fully described in the detailed specification which follows.

DESCRIPTION OF THE PREFERRED EMBODIMENTS

Figure 1A:
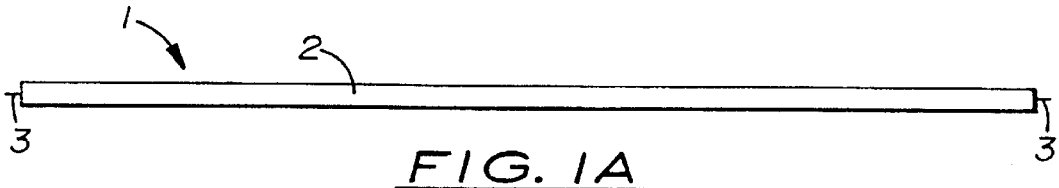
FIG. 1A is a top view of one embodiment of a strip-shaped electroluminescent (EL) panel, according to the invention.
Figure 1B:
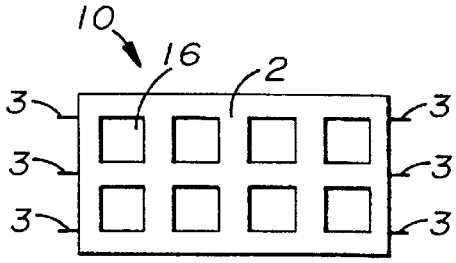
FIG. 1B is a top view of an embodiment of a die-cut sheet-style EL panel with rectangular apertures for receiving key stems.
Figure 1C:
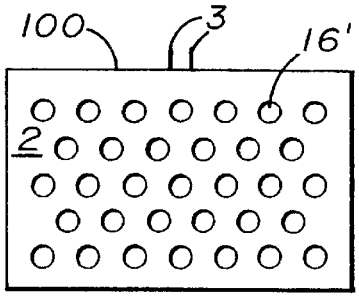
FIG. 1C is a top view of another embodiment of a die-cut sheet-style EL panel with small circular apertures for receiving key stems.
Figure 1D:
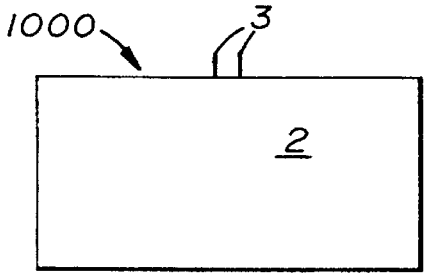
FIG. 1D is a top view of an embodiment of a continuous sheet-style EL panel.

Referring to the Figures, there are shown several, but not the only, embodiments of the invented backlighting system for keyboard. FIGS. 1A–C illustrate electroluminescent (EL) panels that may be used in the present invention. FIG. 1A is a top view of a strip-shaped electroluminescent panel 1. FIG. 1B is a top view of a rectangular die-cut electroluminescent panel 10 with apertures 16 for receiving a plurality of keycaps and stems. FIG. 1C is a top view of a die-cut EL panel 100 that has small circular apertures 16' for receiving a plurality of generally cylindrical stems. FIG. 1D is a top view of an EL panel 1000 that does not require apertures because it extends continuously underneath the keyswitches. Panels 1, 10, 100, 1000 illuminate homogeneously preferably from their entire top surfaces 2, and connect to a power source at terminals 3, which power source is preferably the computer keyboard port. Alternatively, other embodiments may include masking, deactivation or other construction that results in portions of the top surfaces 2 radiating light and portions not radiating light. For example, the inventors envision embodiments in which the panels comprise portions which may not be conventionally classified as EL material, or panels which are EL material but are masked.

Panels 1, 10, 100 are preferably installed by being laid on top of the contact membrane or other circuit board so that the apertures align properly with the areas on the contact membrane corresponding to each key. The keyswitch assemblies are inserted into or over the apertures and, for embodiments with a base plate, the base plate is attached over the EL panel and around the keys.

The panels 1, 10, 100, 1000 are secured in the keyboard by conventional means, such as being friction fit with one or more members, being a thin membrane sandwiched between other layers of the keyboard. The EL material may be material commonly referred to as "EL" such as that available from MetroMark, Inc. of Minnetonka, Minn., U.S.A.

Figure 2:
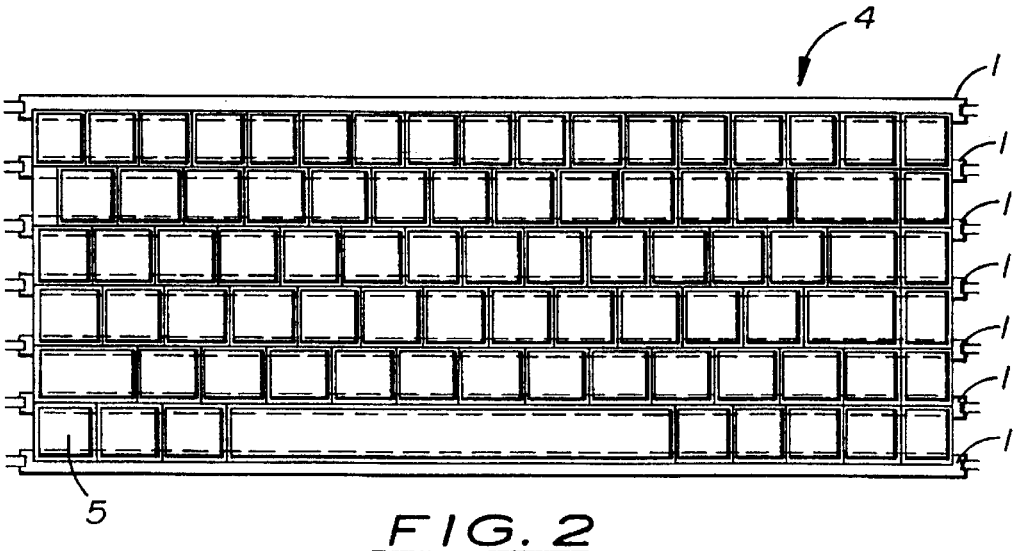
FIG. 2 is a top view of a keyboard layout with horizontal rows of strip-shaped EL panels beneath and between the keyswitch assemblies.

FIG. 2 is a top view of a keyboard layout 4 with elongated strip-shaped electroluminescent panels 1 beneath and between the keycaps 5. The panels illuminate substantially the entire keyboard layout 4 and preferably every keycap 5, due to the effect of the light from the panels 1 radiating up both between the keycaps and through the translucent keycaps 5.

Figure 3:
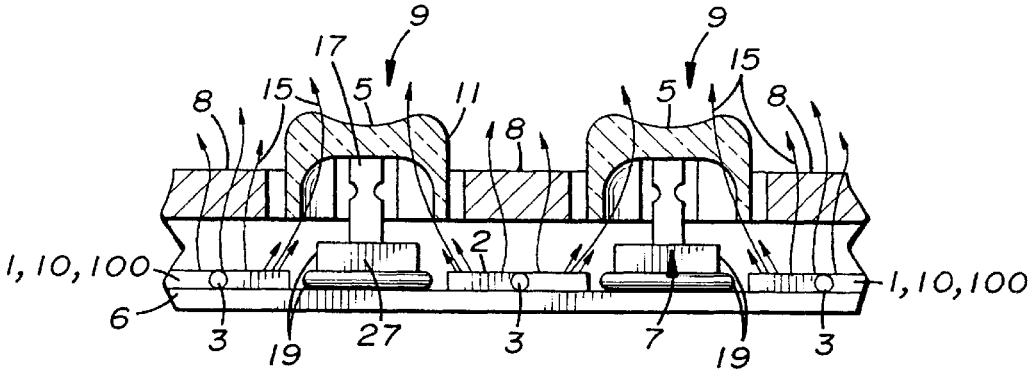
FIG. 3 is a schematic cutaway side view of an embodiment of the invention wherein EL panels radiate light up between the keyswitch keycaps through a translucent base plate and up through the keycaps.
Figure 4:
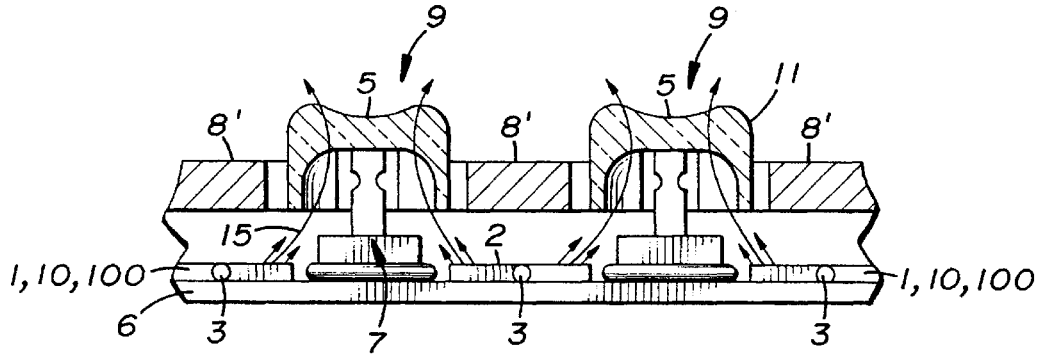
FIG. 4 is a schematic cutaway side view of the embodiment of FIG. 3 with an opaque top housing plate, showing EL panels radiating light up through the keycaps only.

FIGS. 3 and 4 illustrate cutaway side views of a keyboard assembly including discrete keyswitches 9 mounted for contact with printed circuit board 6. Each keyswitch 9 comprises keycaps 5, and stem 7 which includes post 17 and actuating member 27, with at least the cap 5 and post 17 preferably being translucent or transparent. Electroluminescent panels are installed on top of the circuit board 6, underneath the keycaps 5 and beside the stem 7 of each keyswitch. The EL panels, as illustrated, may be either a plurality of strip panels 1 or portions of one or more sheet panels 10, 100 each having its own electrodes 3 for connection to a power source. In the case of strip panels 1, the EL material extends close beside the outside surface of stems 7 on at least two sides, and, in the case of sheet panels 10, 100, the EL material extends closely around the entire outside perimeter or "outer side surface 19" of stems 7. With either EL panel style, the EL material extends under the outer perimeter edge 11 of the keycaps 5, but not inside the keyswitch, and not through any apertures in the stem or keycaps. This way, as depicted by rays 15, the EL material can radiate up from outside the keyswitch up through the cap, and also into the stem and up through the cap top.

In FIG. 3, a translucent base plate 8 is installed over the panels 1, 10, 100, which plate 8 may take the place of the conventional opaque base plat that forms the top of a conventional keyboard housing. In such an embodiment, light radiates through from up through the base plate 8, as well as into and up through the keyswitches, to give an overall "glowing" effect to substantial portions of the keyboard.

In FIG. 4, a less preferred, opaque base plate 8' is installed. In such an embodiment, the opaque base plate 8' substantially blocks the light from radiating up between the keyswitches, so that the light travels only into and up through the keyswitches. Such alternatives are within the scope of the invention, as they still provide substantial lighting to the entire keyswitch and do so by providing the light source around the keyswitches. Additionally, the invention also includes embodiments in which masking is placed directly on or near the upper surface of the EL panels to mask off selected areas of the EL panels, for example, for special design effects desired for artistic reasons or personal preference.

Figure 5:
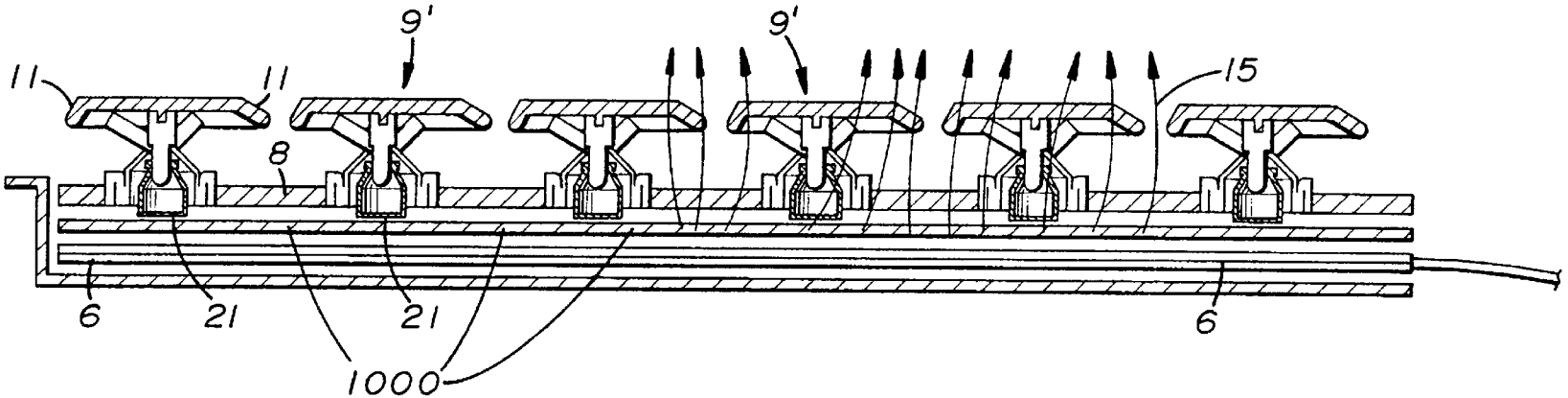
FIG. 5 is a schematic cutaway side view of another embodiment of the invention in which the EL panel extends continuously underneath a plurality of keyswitches.

FIG. 5 illustrates in cutaway view a panel that extends continuously underneath one or more keyswitch assemblies 9'. Such a panel preferably is entirely or substantially EL material so that it may described as an EL sheet that extends, and radiates, continuously underneath one or more keyswitch assemblies. Such a continuous sheet therefore needs no perforations for fitting around the key stem or stem path; instead, the EL sheet 1000 extends across the stem path, and the bottom end 21 of the stem that is pushed down during key depression actually contacts and pushes against the sheet 1000 rather than the contact membrane. The contact of keyswitch to EL sheet 1000 transfers sufficient force to the contact membrane 6 to accomplish the keyswitch's task without direct contact between the keyswitch and the contact membrane. Because the EL sheet 1000 extends continuously underneath the keyswitches 9', the light rays 15 may shine up through the keyswitch as well as up through the space between the keyswitches. Alternatively, the inventors envision that portions of the EL sheet 1000 shown in FIG. 5 may be masked, deactivated, or made from non-radiating material, as desired for economic or aesthetic reasons.

Figure 6A:
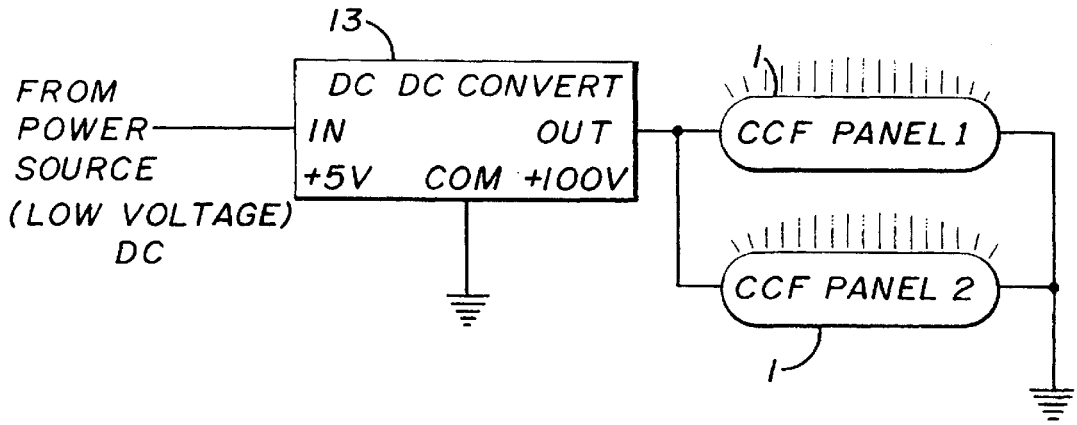
FIG. 6A is a schematic diagram of a typical EL panel wiring diagram.

FIG. 6A is a schematic diagram of a typical wiring diagram for one embodiment of the invented backlighting system. The panels 1 are connected between a common ground and a high voltage source, such as DC-to-DC converter 13, which converts +5 volts to +100 volts in this example. Multiple converters 13 may be applied to drive larger electroluminescent panels 1, or multiple panels.

Figure 6B:
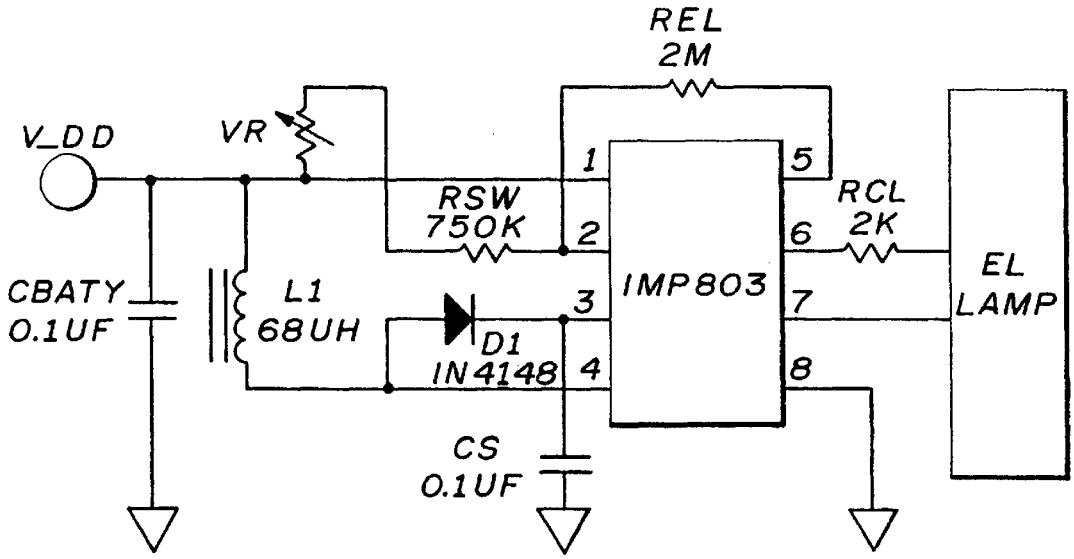
FIG. 6B is schematic diagram of an inverter system for one embodiment of the invention.

FIG. 6*b* is a schematic diagram of an inverter system for the invention. Other circuitry may be used and other inverter systems may be used, however, the digital inverter consumes less power than conventional toroid type inverters and so is preferred. The control system preferably includes an auto-off feature, so that the backlighting automatically turns off after a set period of un-use of the keyboard. This feature will extend the life of the battery and the EL material. A listing of materials that may be used for this circuitry follows:

TABLE 1

| Description | U/M | Schematic No in FIG. 6B |
|---|---|---|
| INVERTER IC - IMP803 | 1 | U1 |
| DIODE - 1N4148 BV = 100V | 1 | D1 |
| VOLUME - 100K | 1 | VR |
| CHOKE COIL - 68uH | 1 | L1 |
| CHIP CAP 0805 TYPE (+80/−20%) | | |
| 0.1UF | 2 | Cbaty, Cs |
| CHIP RESISTOR (0805 TYPE) +/− 10% | | |
| 2K | 1 | Rel |
| 2M | 1 | Rel |
| 750K | 1 | Rsw |
| EL "LAMP" | 1 | EL LAMP |

Figure 7:
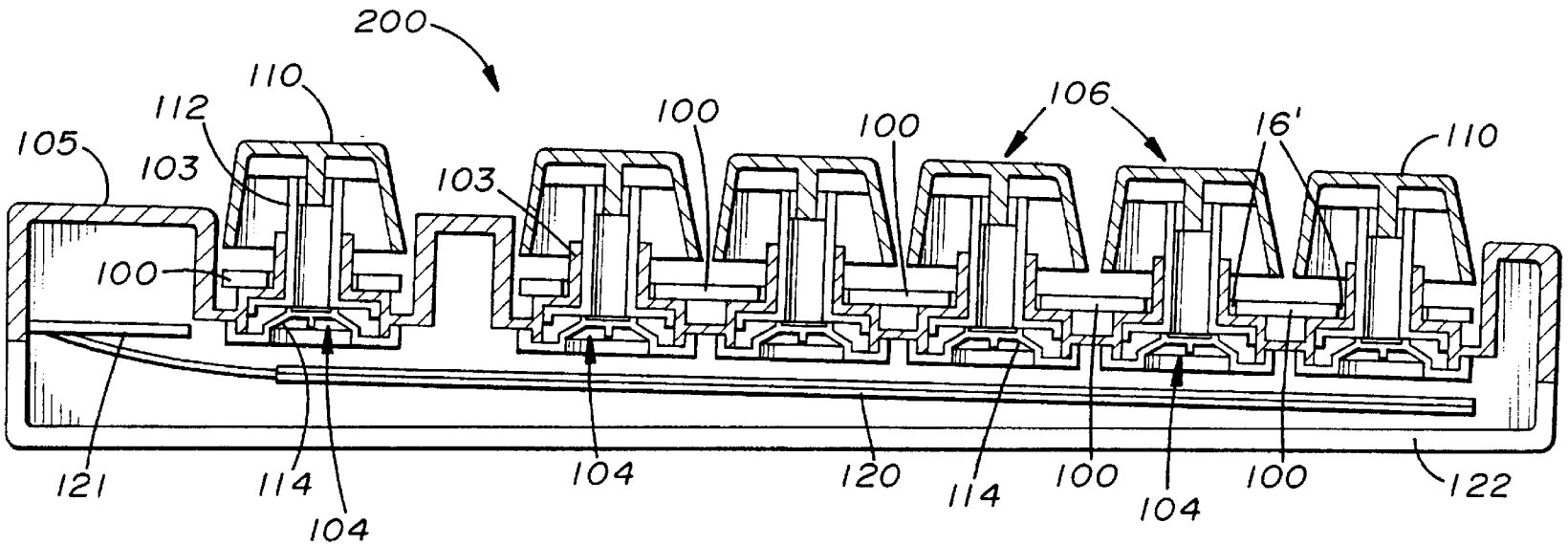
FIG. 7 is an end, cross-sectional view of one embodiment of a desk-top keyboard, according to the invention, showing a perforated panel of EL material around the key stem assemblies and the collar which supports the key stem.
Figure 8:
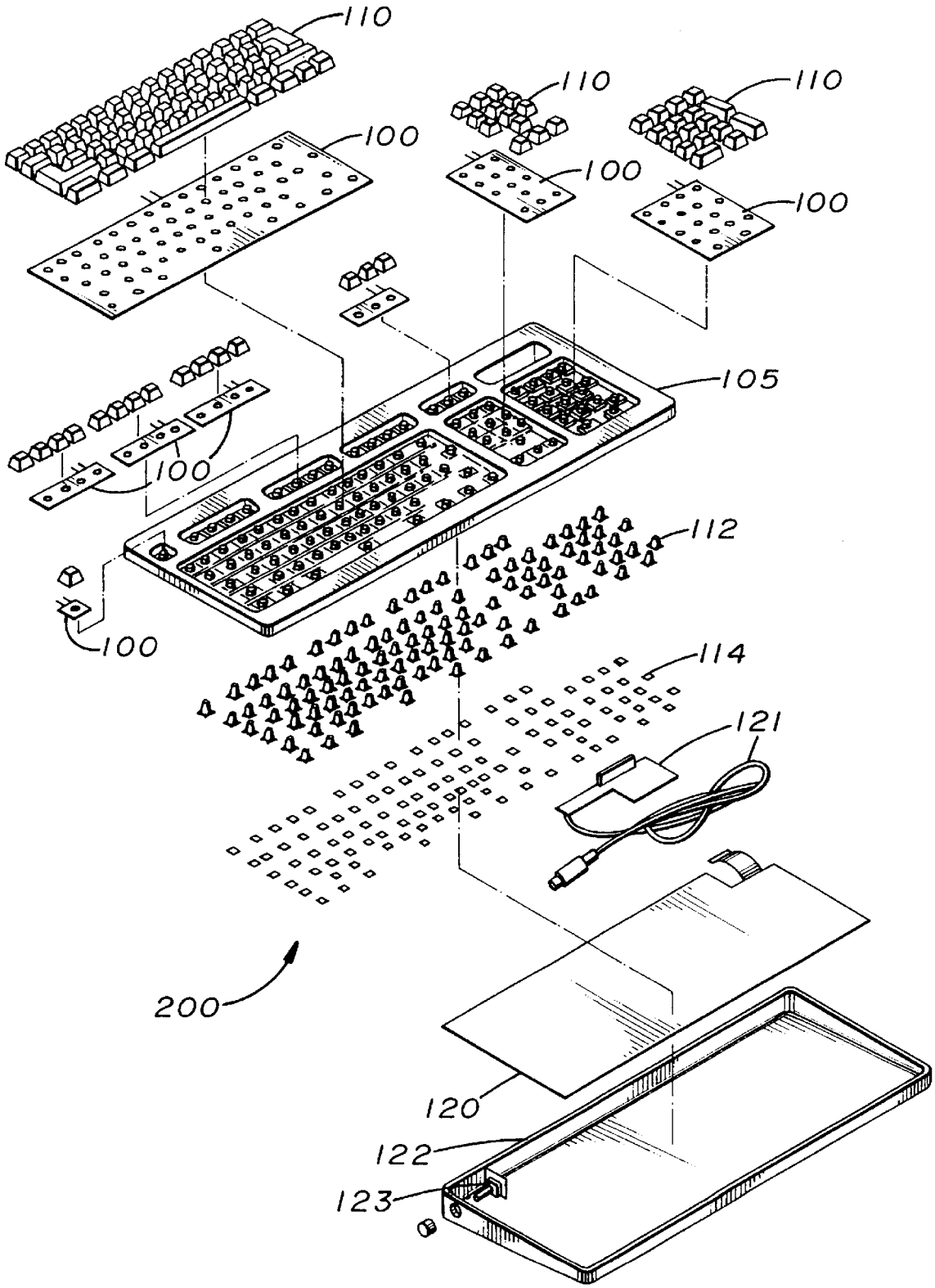
FIG. 8 is an exploded view of the pieces parts of the key board of FIG. 7.

FIGS. 7 and 8 illustrate a particularly preferred embodiment of the present invention, a desktop keyboard 200 with the invented backlighting system. EL sheet(s) 100 are installed to place their apertures 16' snapped around the key collars 103 of the keyboard housing 105, which collars 103 surround the stems 104 of the keyswitch assemblies 106. The apertures 16' preferably have diameters the same as the outer diameters of the collars 103 for frictional engagement of the EL sheet 100 with the collar and so that the EL sheets 100 extend as near as possible to the outside surface of the stems 104. The stems 104, which comprise cap 110, contact insert 112, and actuator 114 as shown disassembled in FIG. 8. The contact inserts 112 slide down in the collars 103 when the key is depressed for contact the contact membrane 120. Membrane 120 is received within the bottom cabinet 122 of the keyboard 200 and cooperates with PCB and connector 121. After a key is released, the insert then slides back up to its original position as biased by the actuator 114. This keyboard 200 does not include masking or any base plate on top of the EL sheets 100, and preferably the contact insert 112, cap 110 are translucent. Therefore, the EL sheets 100 radiate light up between the keycaps 110, and also up through the cap 110 and through the top portion of the contact insert 112. Optionally, the key collars 103 may be translucent, which further allows light from the sheets 100 to pass through the collars 103, into the insert 112, and then up through the cap 110.

As shown to best advantage in FIG. 8, assembly of preferred embodiment 200 is convenient and economical because of the shape and position of the EL sheets 100. The EL material does not interfere with any moving parts and is received in a spaces which are not used for other purpose. As shown in FIG. 8, several different sheets 100 may be installed in various different areas of the keyboard, for example, smaller sheets under the function keys, larger sheets under the letter keys, and medium sheets under the numeric keypad. FIG. 8 illustrates one possible location for light intensity control and knob 123, but various locations may be appropriate for different keyboards. As described above, controls for independent on/off and adjustment of intensity may be included for each or some of the sheets, and may be designed from conventional technology. Also, various light colors may be used, or the sheets may be formed in other that rectangular shapes for personal taste or "designer" appeal.

Figure 9:
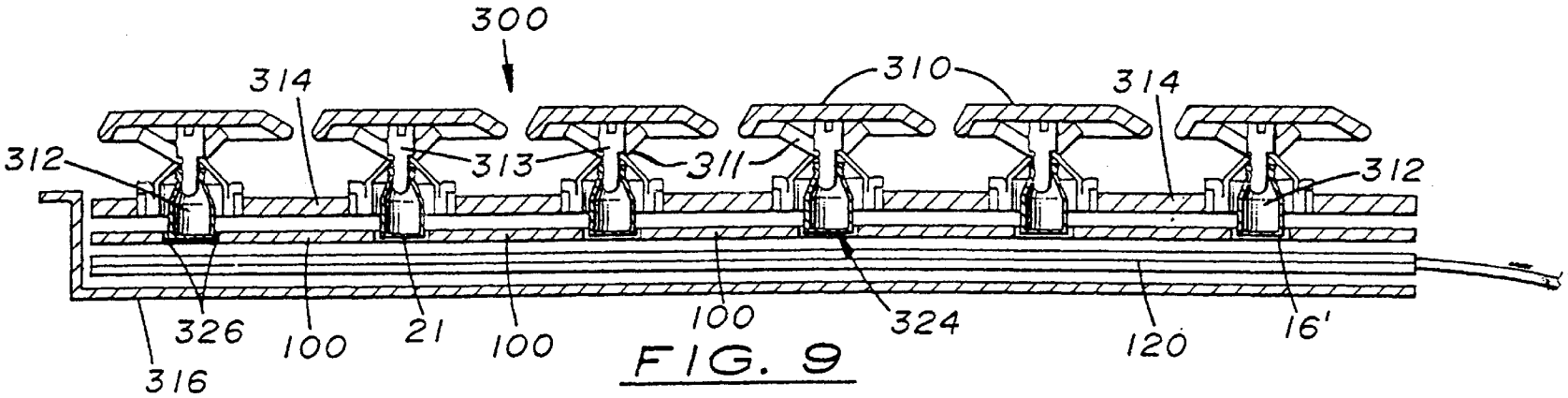
FIG. 9 is an end, cross-sectional view of one embodiment of a lap-top keyboard, according to the invention, showing a perforated panel of EL material around the key stem paths.
Figure 11B:
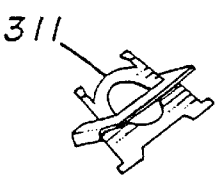
FIG. 11B is an enlarged view of the hinge of FIGS. 9 and 10.
Figure 11A:
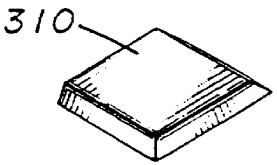
FIG. 11A is an enlarged view of the key cap of FIGS. 9 and 10.
Figure 11C:
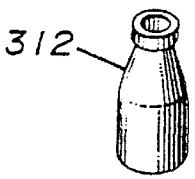
FIG. 11C is an enlarged view of the rubber actuator of FIGS. 9 and 10.
Figure 10:
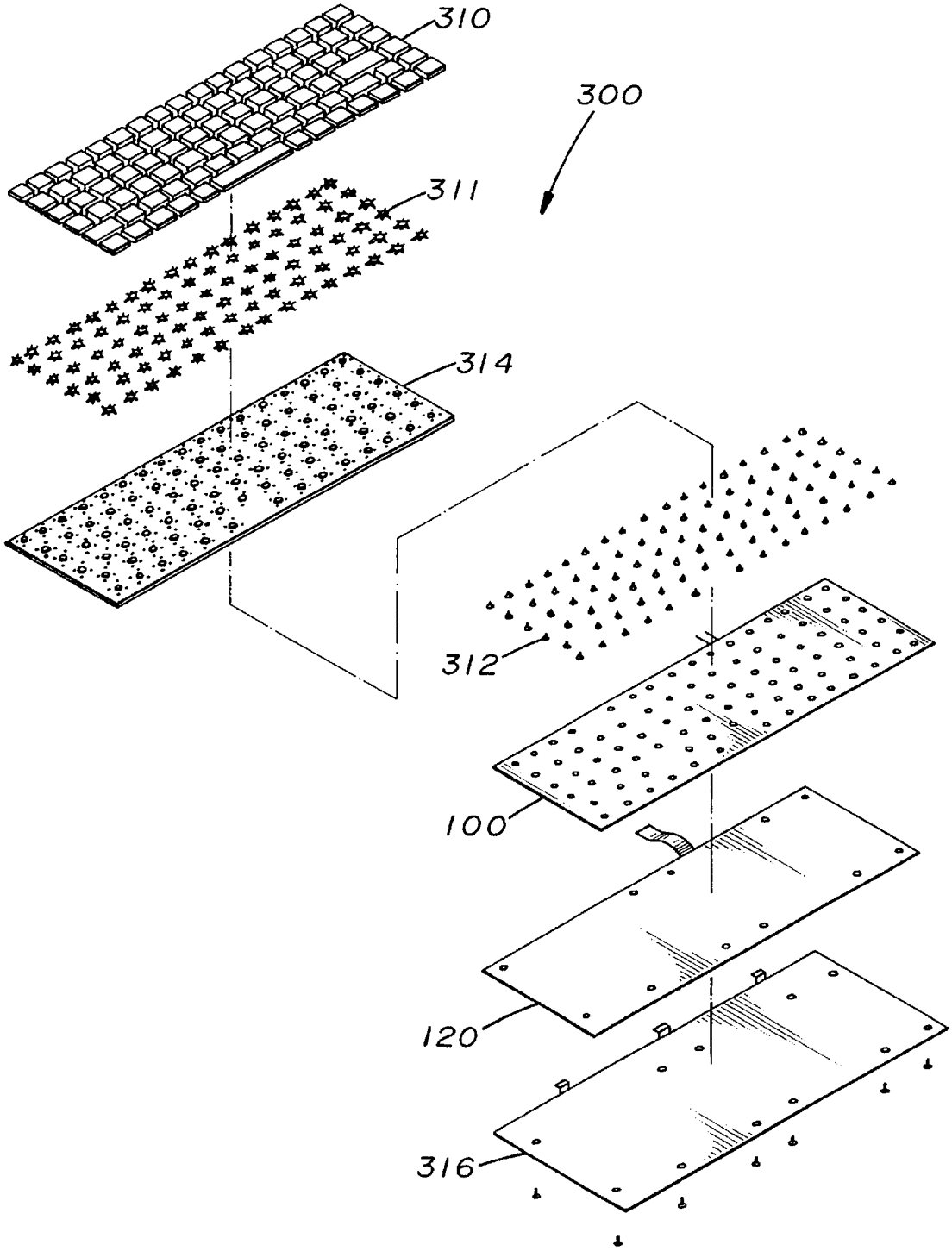
FIG. 10 is an exploded view of the pieces parts of the key board of FIG. 9.

FIGS. 9 and 10 illustrate another especially-preferred embodiment, that is, a laptop keyboard 300. This keyboard 300 includes transparent key caps 310, transparent hinges 311, transparent rubber actuators 312 (biasing members), contact insert 313, transparent base plate 314, contact membrane 120, and metal mounting bracket 316. EL sheet 100 with small round apertures 16' is positioned between and generally parallel to the contact membrane 120 and the base plate 314. Apertures 16' are positioned directly below holes in the base plate 314 which are positioned directly below the actuators 312 and the center of the key caps 310. Thus, the actuators 312, baseplate holes, and apertures 16' are all axially aligned, to define the "stem path 324" in which the "stem" travels, wherein the "stem" in this keyboard design may be considered the actuator 312 and insert 313. Thus, the edge 326 of the EL material, defining the aperture 16', extends to be at or near the stem path. In other words, the EL material preferably extends as far as possible under the key cap 310, without entering into any hole or passage in the keyswitch or into the interior of the keyswitch, without being centered under the cap, and without "light piping" to direct the light up to the center of the cap. This way, the EL "lamp" shines up from the outside of the keyswitch into a substantial portion of the cap and preferably through the hinge to illuminate the key. Also, the EL "lamp" shines up through the plate 314 to provide an appropriately-lit background around the keys. Because the stroke of the laptop keyboard keys is shorter than that in a desktop keyboard, the EL material delivers an adequate light output even from beneath the bottom of the clear base plate 314, and from beneath the transparent hinges 311.

As shown to best advantage in FIG. 10, assembly of keyboard 300 is efficient and convenient, because of the approach of installing the EL panel 100 as a thin, planar sheet parallel to and in between already existing planar members of the keyboard. Enlargements of several of the pieces parts of keyboard 300 are shown in FIGS. 1A–C for clarity.

The nature and position of the EL material in the preferred embodiments also provides the benefit of increased resistence to liquid spills. Having a continuous or near-continuous panel of the EL material extending between and/or under the keyswitches blocks liquid and moisture from reaching the PCB/contact membrane.

Various materials may be used for the parts of the invented system. For example, transparent key caps may be ABS or P.C. plastic; transparent hinges may be nylon or P.C.; transparent or semi-transparent "rubber" actuators may be silicone rubber, Latex, or rubber; transparent or white contact inserts may be POM or nylon; transparent base plates may be ABS or P.C., and lower housing members may be metal or plastic. Other materials may be chosen for the desired translucency and/or color, with durability of the material as a main objective.

The invented keyboard lighting system, with its many possibilities for different colors, patterns of light, and light adjustments, may be designed for the many individual tastes and needs of people in the market. The invented system offers advantages for young people who desire a stylish keyboard, senior or visually-impaired citizens who need help reading the keyboard, or others who are tired of the conventional computer look.

The invention that has been described is effective in providing illumination of a keyboard or different types of keyswitch assemblies, for example, many keyswitch assemblies made with conventional materials by conventional techniques. An important object of the present invention is to provide effective backlighting to keyboards and keyswitches of conventional design, rather than requiring significant redesign of keyboards and keyswitches.

Although this invention has been described above with reference to particular means, materials and embodiments, it is to be understood that the invention is not limited to these disclosed particulars, but extends instead to all equivalents within the scope of the following claims.

What is claimed is:

1. A backlit keyboard for use with a computer or internet television, the keyboard comprising:

a plurality of keyswitches comprising caps having a translucent or transparent portion and stems depending from the caps;

a substantially planar panel of light-emitting electroluminescent material extending beneath a plurality of said caps, wherein the panel is entirely outside of the keyswitches; and a translucent or transparent base plate received below the caps and above said panel;

wherein said panel emits light directly up through said translucent or transparent base plate and into said keyswitches and through said translucent or transparent portion.

2. A backlit keyboard as in claim 1, wherein the panel of light-emitting electroluminescent material is powered by a computer power source with voltage increased by means of a voltage inverter.

3. The keyboard as in claim 1, wherein the panel is an electroluminescent membrane.

4. The keyboard as in claim 1, wherein the caps are substantially translucent or transparent.

5. The keyboard as in claim 1, wherein the stems are substantially translucent or transparent.

6. The keyboard as in claim 1, wherein the keyswitches are substantially translucent or transparent.

7. The keyboard as in claim 1, wherein the keyboard further comprises hinges located underneath the caps, wherein at least one of said hinges is substantially translucent or transparent.

8. The keyboard as in claim 1, wherein the panel emits light up between the caps.

9. The keyboard as in claim 1, further comprising opaque masking between at least some of the keyswitches for blocking light from the panel from emitting up between the caps.

10. The keyboard as in claim 1, wherein portions of the panel between some of the plurality of keyswitches are made from non-radiating material to limit light from radiating up between the caps of said some of the plurality of keyswitches.

11. The keyboard as in claim 1, wherein the panel is continuous between and underneath said plurality of keyswitches and has no perforations for keyswitches.

12. The keyboard as in claim 1, wherein the keyboard further comprises hinges underneath the caps, wherein at least one of said hinges is substantially translucent or transparent nylon.

13. The keyboard as in claim 1, wherein the stems each have an outer side surface, and the panel has one or more perforations and a perforation edge defining each perforation, wherein the panel receives the stems in the perforations and the perforation edge extends near to the stem outer side surface for emitting light through the keyswitches.

14. The keyboard as in claim 13, wherein the panel is an electroluminescent membrane.

15. The keyboard as in claim 13, wherein the caps are substantially translucent or transparent.

16. The keyboard as in claim 13, wherein the stems are substantially translucent or transparent.

17. The keyboard as in claim 13, wherein the keyswitches are substantially translucent or transparent.

18. The keyboard as in claim 13, wherein the keyboard further comprises hinges underneath the caps, wherein at least one of the hinges is substantially translucent or transparent.

19. The keyboard as in claim 1, wherein:

the keyboard further comprises a circuit board or membrane generally parallel to and below said panel;

the stems have bottom ends;

the panel has one or more perforations and a perforation edge defining each perforation, and the panel is located substantially between the keyswitches and the circuit board or membrane, the perforations are directly below the stem bottom ends for receiving the stem bottom ends when the keyswitches are depressed to contact the circuit board or membrane.

20. The keyboard as in claim 19, wherein portions of the panel between some of the plurality of keyswitches are made from non-radiating material to limit light from radiating up between the caps of said some of the plurality of keyswitches.

21. The keyboard as in claim 19, wherein the panel is an electroluminescent membrane.

22. The keyboard as in claim 19, wherein the caps are substantially translucent or transparent.

23. The keyboard as in claim 19, wherein the stems are substantially translucent or transparent.

24. The keyboard as in claim 19, wherein the keyswitches are substantially translucent or transparent.

25. The keyboard as in claim 19, wherein the keyboard further comprises hinges underneath the caps, wherein at least one of the hinges is substantially translucent or transparent.

26. The keyboard as in claim 1, wherein:

the keyboard further comprises a circuit board or membrane generally parallel to and below said panel;

the stems have bottom ends;

the panel is continuous and is located between the keyswitches and the circuit board or membrane so that, when the keyswitch is depressed, the keyswitch contacts the panel to apply pressure to the circuit board or membrane.

27. A backlit keyboard for use with a computer or internet television, the keyboard comprising:

a plurality of keyswitches comprising caps having a translucent or transparent portion and stems depending from the caps; and a substantially planar panel of light-emitting electroluminescent material extending beneath a plurality of said caps, wherein the stem do not extend through the panel;

wherein said panel emits light into said keyswitches and through said translucent or transparent portion; and wherein the keyboard does not include any base plate above the panel of light-emitting electroluminescent material.

28. A backlit keyboard as in claim 27, wherein the keyboard does not include any masking on said panel.

29. A backlit keyboard as in claim 27, wherein the panel of light-emitting electroluminescent material is powered by a computer power source with voltage increased by means of a voltage inverter.

30. A backlit keyboard as in claim 27, wherein the panel is an electroluminescent membrane.

31. The keyboard as in claim 27, wherein the caps are substantially translucent or transparent.

32. The keyboard as in claim 27, wherein the stems are substantially translucent or transparent.

33. The keyboard as in claim 27, wherein the keyswitches are substantially translucent or transparent.

34. The keyboard as in claim 27, wherein the keyboard further comprises hinges underneath the caps, wherein at least one of the hinges is substantially translucent or transparent.

35. The keyboard as in claim 27, wherein the keyboard further comprises hinges underneath the caps, wherein at least one of said hinges is substantially translucent or transparent nylon.

36. The keyboard as in claim 27, wherein portions of the panel between some of the plurality of keyswitches are made from non-radiating material to limit light from radiating up between the caps of said some of the plurality of keyswitches.

37. The keyboard as in claim 27, wherein the stems each have an outer side surface, and the panel has one or more perforation and a perforation edge defining each perforation, wherein the panel receives the stems in the perforations and the perforation edge extends near to the stem outer side surface for emitting light through the keyswitches.

* * * * *

UNITED STATES PATENT AND TRADEMARK OFFICE

CERTIFICATE OF CORRECTION

PATENT NO. : 6,765,503 B1
APPLICATION NO. : 09/831777
DATED : July 20, 2004
INVENTOR(S) : Chan et al.

It is certified that error appears in the above-identified patent and that said Letters Patent is hereby corrected as shown below:

On Title Page (item 73) Assignee: Lightpath "Technologies", Inc. should read Lightpath Technology , Inc.

Signed and Sealed this

Eleventh Day of July, 2006

JON W. DUDAS
*Director of the United States Patent and Trademark Office*